United States Patent [19]

Kohama et al.

[11] Patent Number: 4,562,818

[45] Date of Patent: Jan. 7, 1986

[54] METHOD AND APPARATUS FOR CONTROLLING THE AIR-FUEL RATIO IN AN INTERNAL COMBUSTION ENGINE

[75] Inventors: Tokio Kohama, Nishio; Hideki Obayashi, Okazaki; Hisasi Kawai, Toyohashi; Toshikazu Ina, Aichi; Takashi Shigematsu; Setsuo Tokoro, both of Susono, all of Japan

[73] Assignee: Nippon Soken, Inc., Nishio, Japan

[21] Appl. No.: 627,621

[22] Filed: Jul. 3, 1984

[30] Foreign Application Priority Data

Jul. 5, 1983 [JP] Japan ..... 58-120997
Dec. 7, 1983 [JP] Japan ..... 58-229831

[51] Int. Cl.[4] ..... F02B 3/02; F02D 5/02

[52] U.S. Cl. ..... 123/478; 123/415; 364/431.08

[58] Field of Search ..... 123/478, 425, 435, 487, 123/419, 417, 415, 421; 364/431.08, 41.03, 431.04

[56] References Cited

U.S. PATENT DOCUMENTS

| | | | |
|---|---|---|---|
| 4,345,561 | 8/1982 | Kondo et al. | 123/478 |
| 4,347,571 | 8/1982 | Leung et al. | 123/478 |
| 4,359,991 | 11/1982 | Stumpp et al. | 123/478 |
| 4,380,800 | 4/1983 | Wilkenson | 123/478 |
| 4,383,514 | 5/1983 | Fiala | 123/478 |
| 4,418,673 | 12/1983 | Tominari et al. | 123/478 |
| 4,465,051 | 8/1984 | Hasegawa | 123/478 |
| 4,480,620 | 11/1984 | Tange et al. | 123/478 |

*Primary Examiner*—Raymond A. Nelli
*Attorney, Agent, or Firm*—Cushman, Darby & Cushman

[57] ABSTRACT

In an internal combustion engine, a standard deviation of combustion variations generated for every firing stroke of at least one cylinder is calculated. The misfire limit of the engine is detected by determining whether or not the calculated standard deviation is greater than a reference value. When the calculated standard deviation is greater than the reference value, the controlled air-fuel ratio is decreased, while when the calculated standard deviation is not greater than the reference value, the controlled air-fuel ratio is increased, thereby attaining a lean burn system without a lean mixture sensor.

22 Claims, 18 Drawing Figures

| Fig. 4 A | Fig. 4 B |
|---|---|

| Fig. 5A | Fig. 5B |
|---|---|

| Fig. 8A | Fig. 8 B |
|---|---|

| |
|---|
| Fig. 9A |
| Fig. 9B |

Fig. 10

| B1 \ N | N 1 | N 2 | N 3 | N 4 | N 5 |
|---|---|---|---|---|---|
| B 1 , 1 | C 1 | ··· | ··· | ··· | ··· |
| B 1 , 2 | ⋮ | | | | |
| B 1 , 3 | ⋮ | | | | |
| B 1 , 4 | ⋮ | | | | |
| B 1 , 5 | ⋮ | | | | |

METHOD AND APPARATUS FOR CONTROLLING THE AIR-FUEL RATIO IN AN INTERNAL COMBUSTION ENGINE

BACKGROUND OF THE INVENTION

1. Field of the Invention

The present invention relates to a method and apparatus for feedback control of the air-fuel ratio in an internal combustion engine.

2. Description of the Prior Art

As measures taken against exhaust gas pollution and fuel consumption, a lean burn system has recently been developed. According to this lean burn system, a lean mixture sensor is provided for generating an analog current in proportion to the air-fuel mixture on the lean side in an exhaust pipe of an engine. Thus, the feedback of the air-fuel ratio of the engine can be controlled by using the analog output of the lean mixture sensor, thereby attaining a voluntary air-fuel ratio on the lean side.

In the above-mentioned lean burn system, however, although it is advantageous in view of fuel consumption to control the feedback of the air-fuel ratio, so that it may shift on the leaner side, the feedback controlled value of the air-fuel ratio is affected by the characteristics of the lean mixture sensor, the exhaust gas composition characteristics and the like. That is, the feedback controlled value often deviates from a desired value as a result of the individual differences in the control characteristics of the parts of the engine due to aging of the engine or due to environmental changes. Therefore, if the controlled value of the air-fuel ratio is very close to a misfire limit, the air-fuel ratio may deviate into the misfire limit, thereby inviting misfiring of the engine. In order to avoid such misfiring, the controlled value of the air-fuel ratio is actually within a stable region sufficiently apart from the misfiring limit. Nevertheless, the controlled air-fuel ratio may be near the misfire limit due to aging of the engine or due to environmental changes, thus inviting misfiring of the engine and reducing the drivability.

SUMMARY OF THE INVENTION

It is an object of the present invention to provide a method and apparatus for controlling the air-fuel ratio in an internal combustion engine in which the feedback control of the air-fuel ratio on the lean side is possible without inviting misfiring of the engine, thereby improving the drivability.

According to the present invention, a standard deviation of combustion variations generated for every firing stroke of at least one cylinder is calculated. The misfire limit of the engine is detected by determining whether or not the calculated standard deviation is greater than a reference value, the controlled air-fuel ratio is decreased, while when the calculated standard deviation is not greater than the reference value, the controlled air-fuel ratio is increased.

In the present invention, since the above-mentioned combustion variations are detected by variations in an output of the engine, such as engine rotational speed variations, engine torque variations, pressure variations in a cylinder, and the like, a lean mixture sensor is not necessary.

BRIEF DESCRIPTION OF THE DRAWINGS

The present invention will be more clearly understood from the description as set forth below with reference to the accompanying drawings, wherein:

FIG. 10 is a diagram of the map MAP1 used in the flowchart of FIG. 5.

DESCRIPTION OF THE PREFERRED EMBODIMENTS

Figure 1:
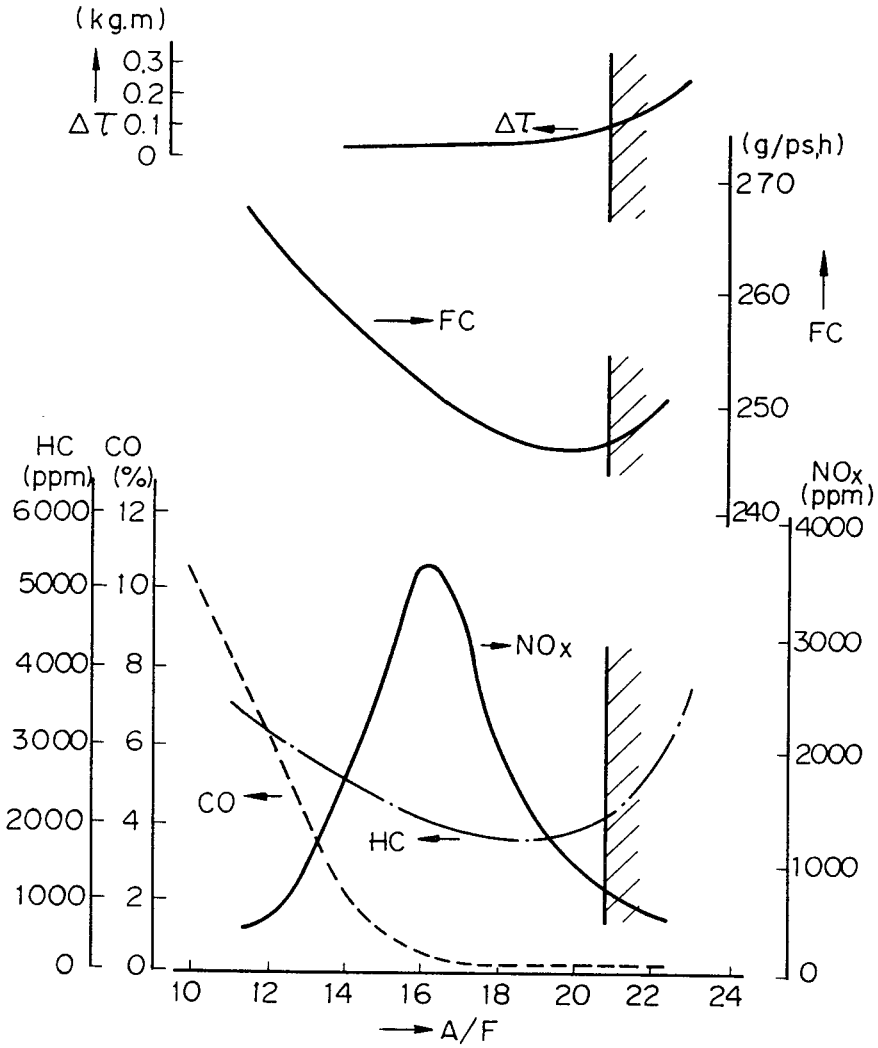
FIG. 1 is a graph explaining the principle of the present invention.

In FIG. 1, which illustrates the principle of the present invention, CO, HC, and NOx designate three gas-containing pollutants, i.e., carbon monoxide, unburned hydrocarbons, and nitrogen oxides, respectively. When the air-fuel ratio A/F becomes on the lean side, thus approaching a misfire region indicated by a shaded portion, such pollutants, especially NOx, decrease, and, the fuel consumption rate FC also decreases. However, when the air-fuel ratio A/F enters the misfire region, the fuel consumption rate FC rapidly increases and the torque variation $\Delta\tau$ also rapidly increases. Therefore, in order to avoid the exhaust gas pollution and improve the fuel consumption, it is preferable that the air-fuel ratio A/F be on the lean side and close to the misfire region. Further, the air-fuel ratio A/F is controlled so that the torque variation $\Delta\tau$ is below a definite value, thus preventing the air-fuel ratio A/F from entering the misfire region. That is, the misfire limit can be considered as the point at which the torque variation $\Delta\tau$ rapidly rises. Therefore, the feedback control of the air-fuel ratio obtaining a definite torque variation enables operation of the engine at a point close to the optimum lean limit.

Figure 2A:
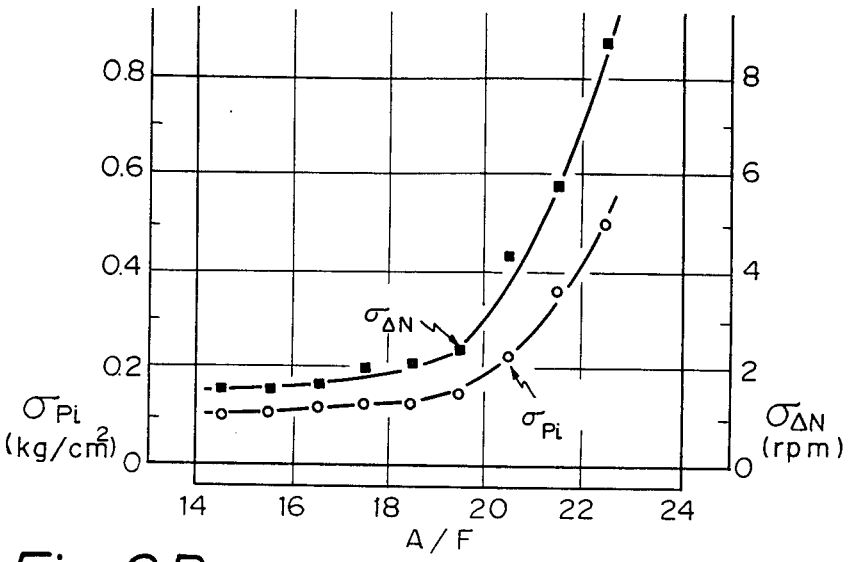
FIGS. 2A and 2B are graphs showing the relationship between the engine rotational speed and the pressure within a cylinder of the engine.
Figure 2B:
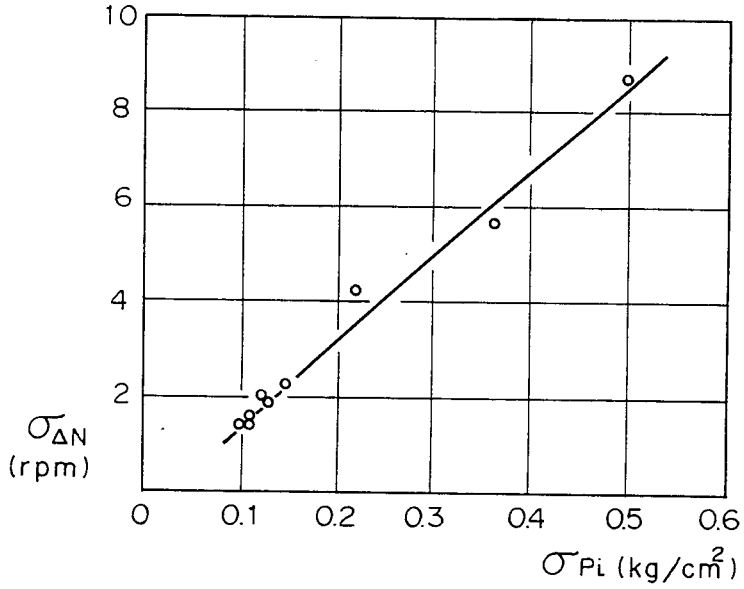
Figures 6A, 6B, 6C:
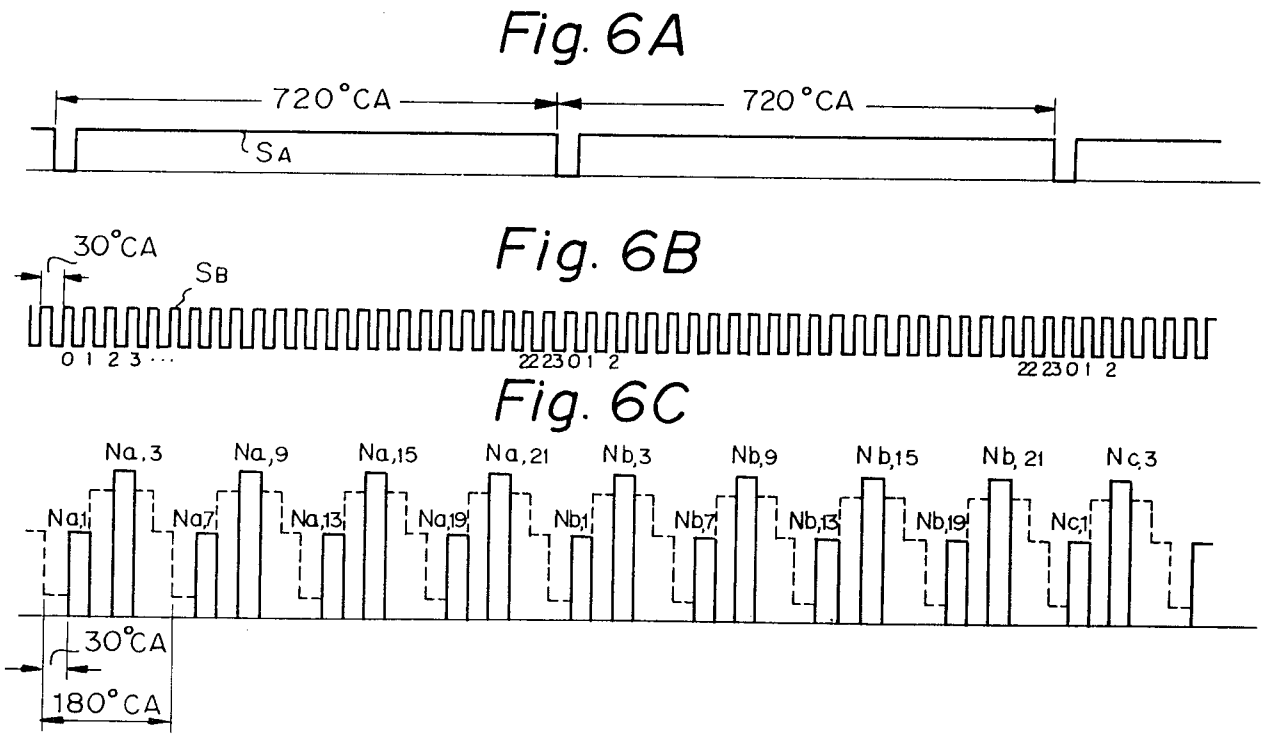
FIG. 6A is a waveform diagram of the TDC signal of FIG. 4.
FIGS. 6B and 6C are waveform diagrams of the angle signal of FIG. 4.

The above mentioned torque variation is due to the combustion variation of the engine, which corresponds to the pulse-like engine rotational speed variation generated for every firing stroke of th engine (see FIG. 6C). Also, as illustrated in FIGS. 2A and 2B, the engine rotational speed variation corresponds to the pressure within a cylinder of the engine. Therefore, the lean limit is detected by the engine combustion variations, such as the engine speed variations, the torque variations sensed by a torque sensor, and the pressure within a cylinder sensed by a pressure sensor. That is, a standard deviation of combustion variations is calculated, and the calculated standard deviation is compared with a reference value. As a result of this comparison, when the calculated standard deviation is greater than the reference value, an air-fuel ratio compensation factor which is an integral value is increased so as to decrease the controlled air-fuel ratio, while when the calculated standard deviation is not greater than the reference value, the air-fuel ratio compensation factor is decreased so as to increase the controlled air-fuel ratio. Thus, the engine can be operated at a lean limit air-fuel ratio close to but outside of the misfire region.

In FIGS. 2A and 2B, $\sigma_{\Delta N}$ designates a standard deviation of the engine rotational speed variations, and $\sigma_{pi}$ designates a standard deviation of the pressure variations within a cylinder of the engine.

Figure 3:
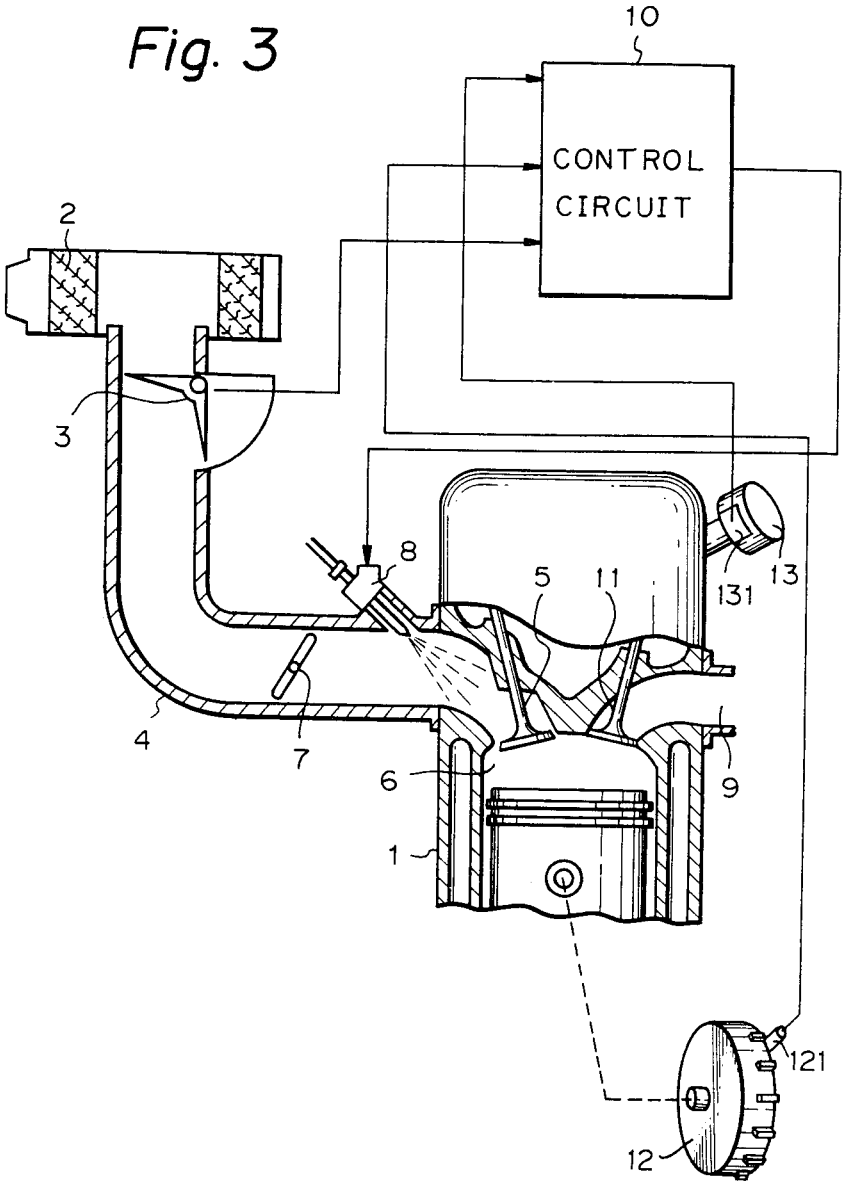
FIG. 3 is a schematic diagram of an internal combustion engine according to the present invention.

In FIG. 3, which is a schematically illustration of an internal combustion engine according to the present invention, reference numeral 1 designates a 4-stroke-cycle 4 cylinder engine mounted in an automobile. The combustion air is sucked via an air cleaner 2, an airflow meter 3, an intake pipe 4, and an intake valve 5 into a combustion chamber 6 of the engine 1. Provided in the intake pipe 4 is a throttle valve 7 operated arbitrarily by a driver. The fuel is supplied to the combustion chamber 6 from the fuel system (not shown) through an electromagnetic fuel injector 8 located in the intake pipe 4. The mixture of fuel and combustion air is burned within the fuel chamber 6, and is discharged from an exhaust valve 11 via an exhaust pipe 9 into the atmosphere.

Mounted on a pulley located at the distal end of the crankshaft (not shown) is an angle signal plate 12, which is a magnetic disk having 12 teeth on its outer periphery. In addition, mounted in a position opposed to the teeth of the angle signal plate 12 is an angle signal sensor 121. The sensor 121 generates one pulse every time one tooth of the signal plate 12 passes the sensor 121. Therefore, the sensor 121 generates a signal of 12 pulses for each revolution of the crankshaft, i.e., a 30° crank angle (CA) signal $S_B$. Note that the crankshaft rotates twice during the period in which the first to fourth cylinders complete the firing stroke sequence.

Reference numeral 13 designates a distributor which incorporates a cylinder determination sensor 131. The cylinder determination sensor 131 generates a pulse signal at a time corresponding to the top dead center position of the first cylinder, i.e., a 720° CA signal (hereinafter referred to as a TDC signal $S_A$).

A control circuit 10 responds to the signals of the cylinder determination sensor 131, the angle single sensor 121, and the airflow meter 3 to calculate a fuel injection amount, thereby controlling the injectors 8. The control circuit 10 may be comprised of a microcomputer.

Figures 4, 4A:
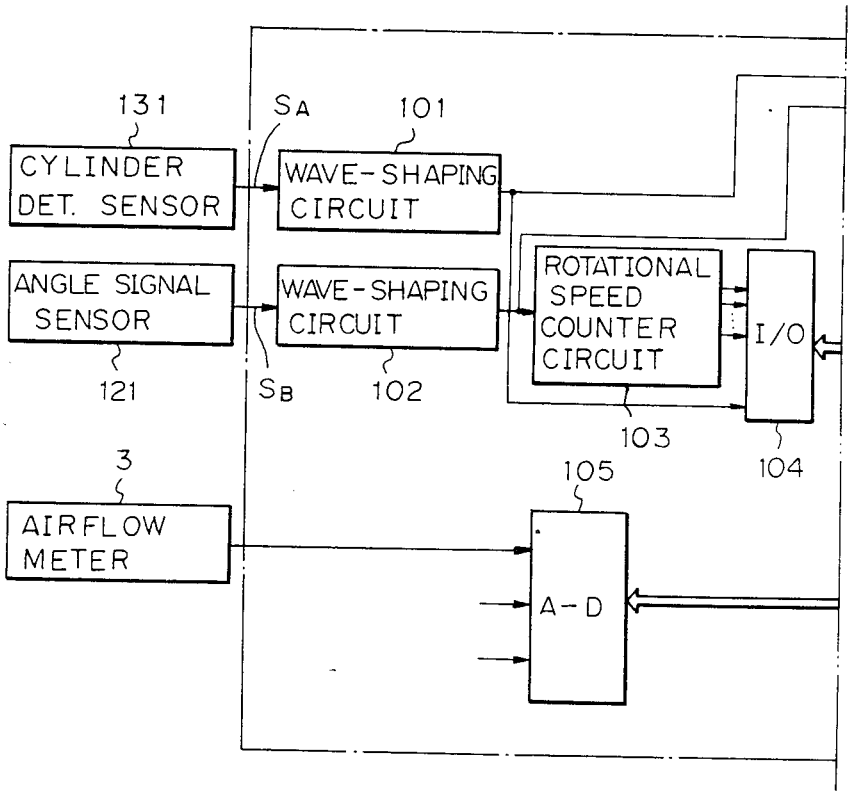
FIGS. 4A and 4B are block diagrams of the control circuit of FIG. 3.
Figure 4B:
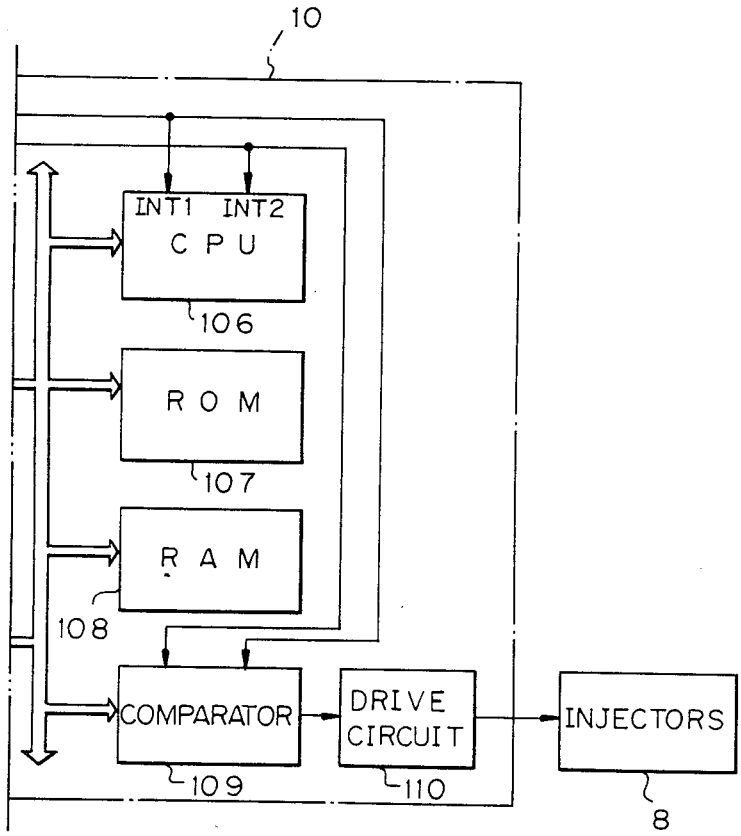

The control circuit 10 will be explained in detail with reference to FIG. 4. The TDC signal $S_A$ from the cylinder determination sensor 131 is shaped by a wave-shaping circuit 101 and is supplied to an input/output interface 104, an interrupt terminal INT1 of a central processing unit (CPU) 106, and a comparator 109. When the TDC signal $S_A$ from the wave-shaping circuit 101 is supplied to the interrupt terminal INT1 of the CPU 106, the CPU 106 carries out an interrupt routine for controlling a fuel injection amount, which will be later explained with reference to FIG. 5 or 8. In the comparator 109, the TDC signal $S_A$ serves as a signal for starting an injection time period. That is, when the comparator 109 receives the trailing edge of the TDC signal $S_A$ from the wave-shaping circuit 101, the comparator 109 is reset to operate a driver circuit 110, thereby activating the injectors 8. An angle signal $S_B$ from the angle signal sensor 121 is shaped by a wave-shaping circuit 103, and is supplied to a rotation speed counter circuit 103, an interrupt terminal INT2 of the CPU 106, and the comparator 109. The rotational speed counter circuit 103 comprises a 16-bit binary counter which counts clock signals (not shown) for the period of 30° CA of the angle signal $S_B$, thereby obtaining a digital value inversely proportional to the engine rotational speed. The digital value of the counter circuit 103 is supplied via the input/output interface 104 to the CPU 106 which, in turn, calculates the engine rotational speed (see: steps 708 and 709 of FIGS. 7 and 9). When the angle signal $S_B$ from the wave-shaping circuit 102 is supplied to the interrupt terminal INT2, the CPU 106 carries out an interrupt routine for calculating an engine rotational speed and a combustion deviation such as an engine rotational speed deviation, which will be later explained with reference to FIG. 7 or 9. In the comparator 109, the angle signal is used to count the injection timing angle. The output voltage of the airflow meter 3 is supplied to an analog/digital (A/D) converter 105 incorporating a multiplexer. The A/D converter 105 subjects the output voltage of the airflow meter 105 to an A/D conversion and the result is supplied to the CPU 106.

The A/D converter 105 uses a known 12-bit A/D converter such as Burr Brown's ADC 80, and the CPU 106 uses a 16-bit microcomputer such as Texas Instrument's TMS 9900.

The comparator 109 converts binary data of a fuel injection time period calculated by the CPU 106 into a pulse having the corresponding width to this time period, which is supplied to the driver circuit 111, thus activating the injectors 8.

Figures 5, 5A:
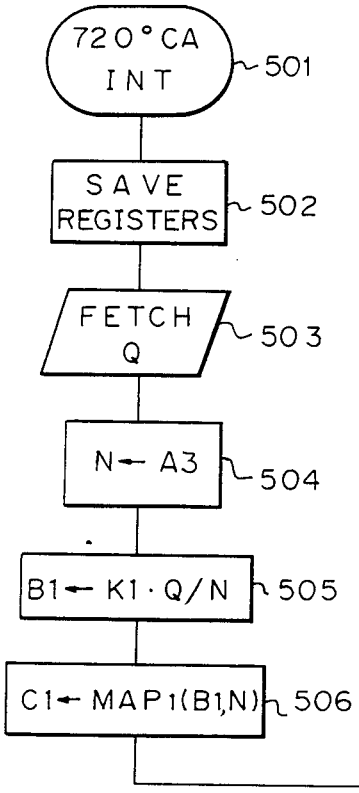
FIGS. 5A and 5B, 7A and 7B, 8A and 8B, and 9A and 9B are flowcharts showing the operation of the control circuit of FIG. 3.
Figure 5B:
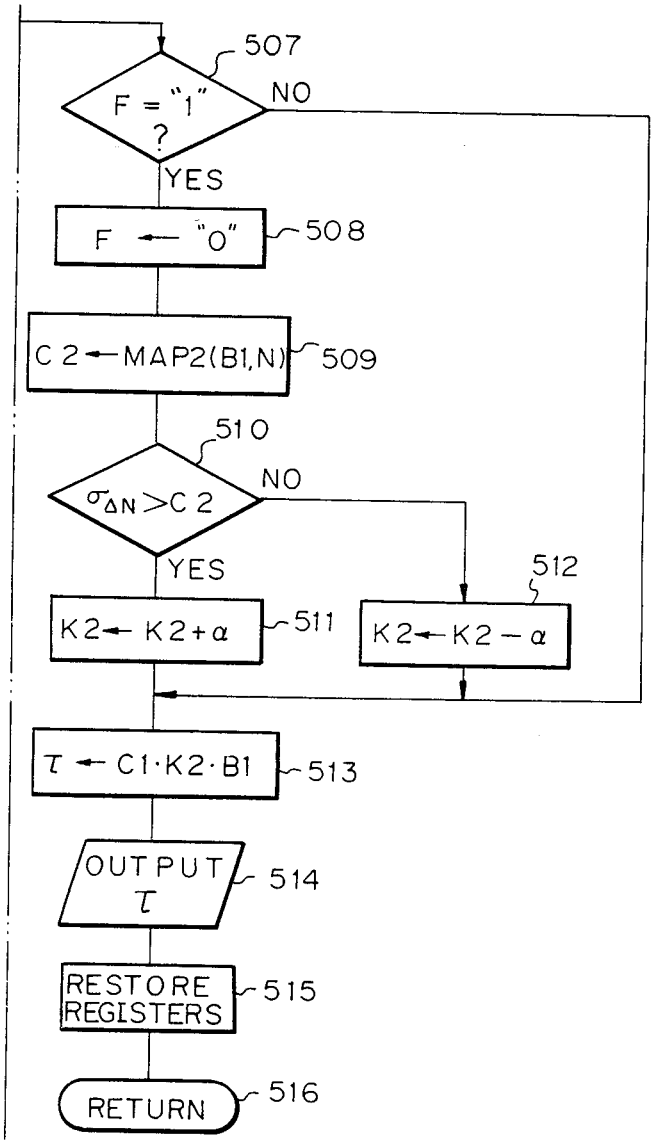
Figure 7A:
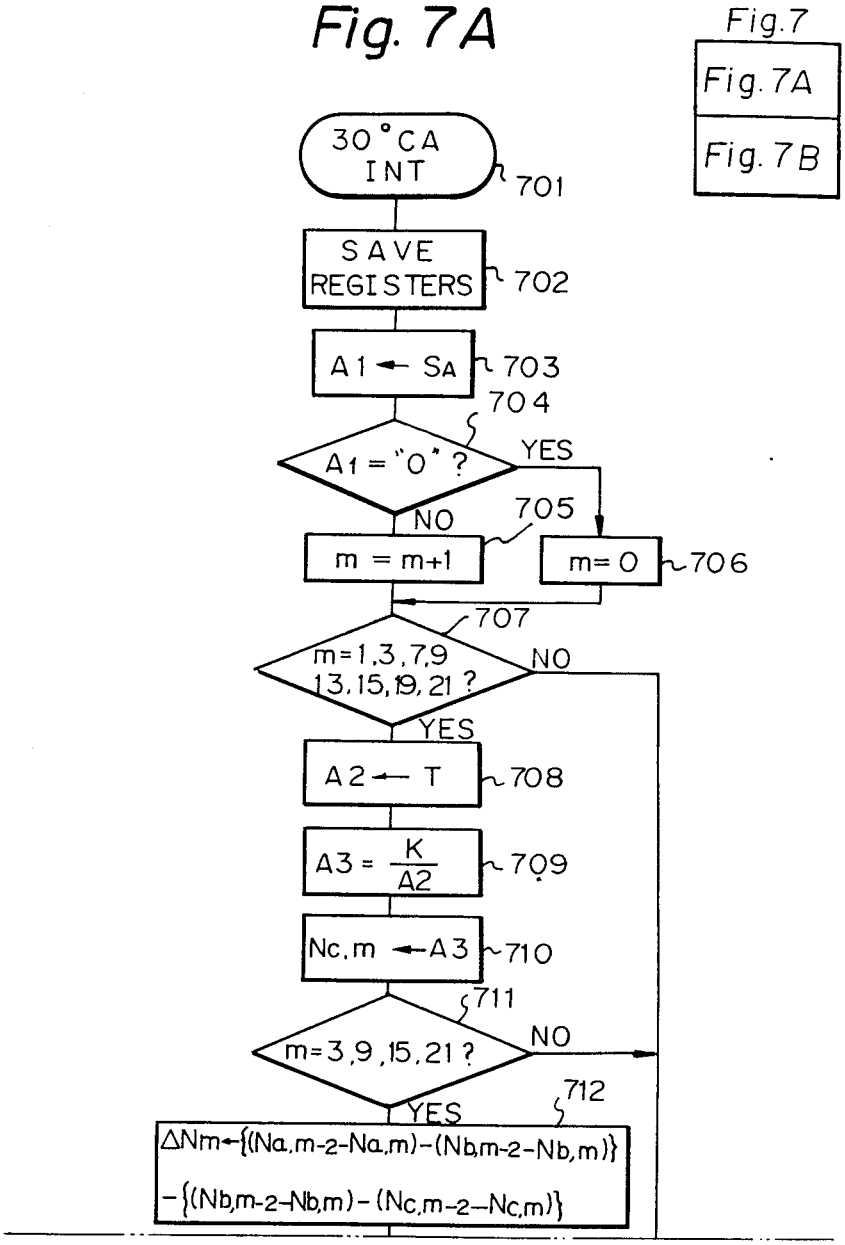
Figure 7B:
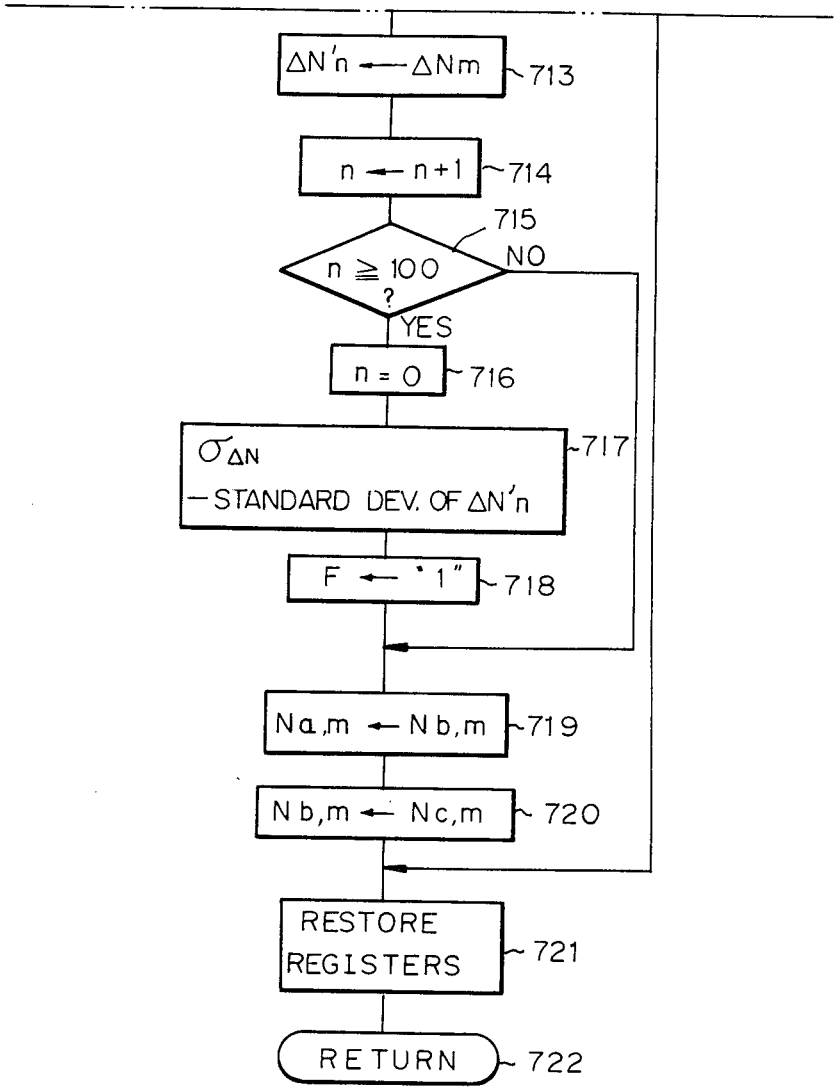
Figures 8, 8A:
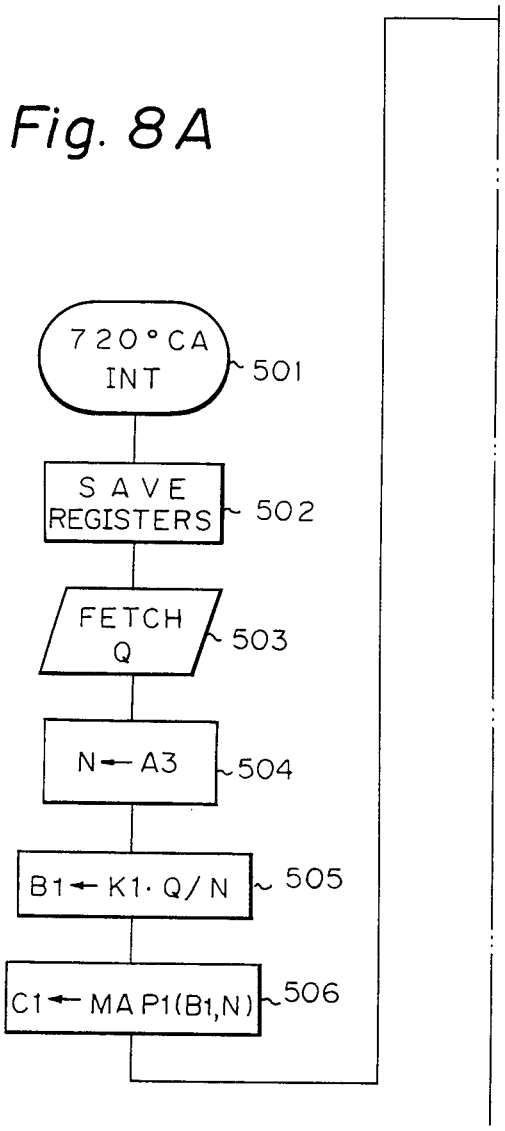
Figure 8B:
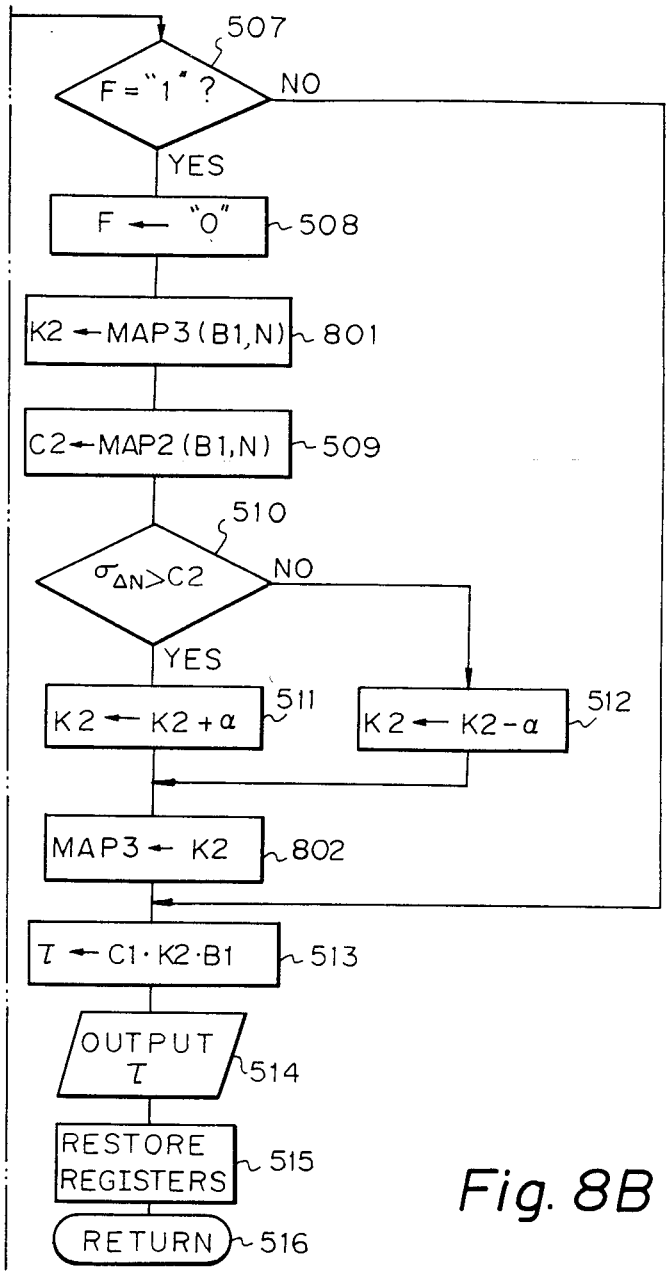
Figures 9, 9A:
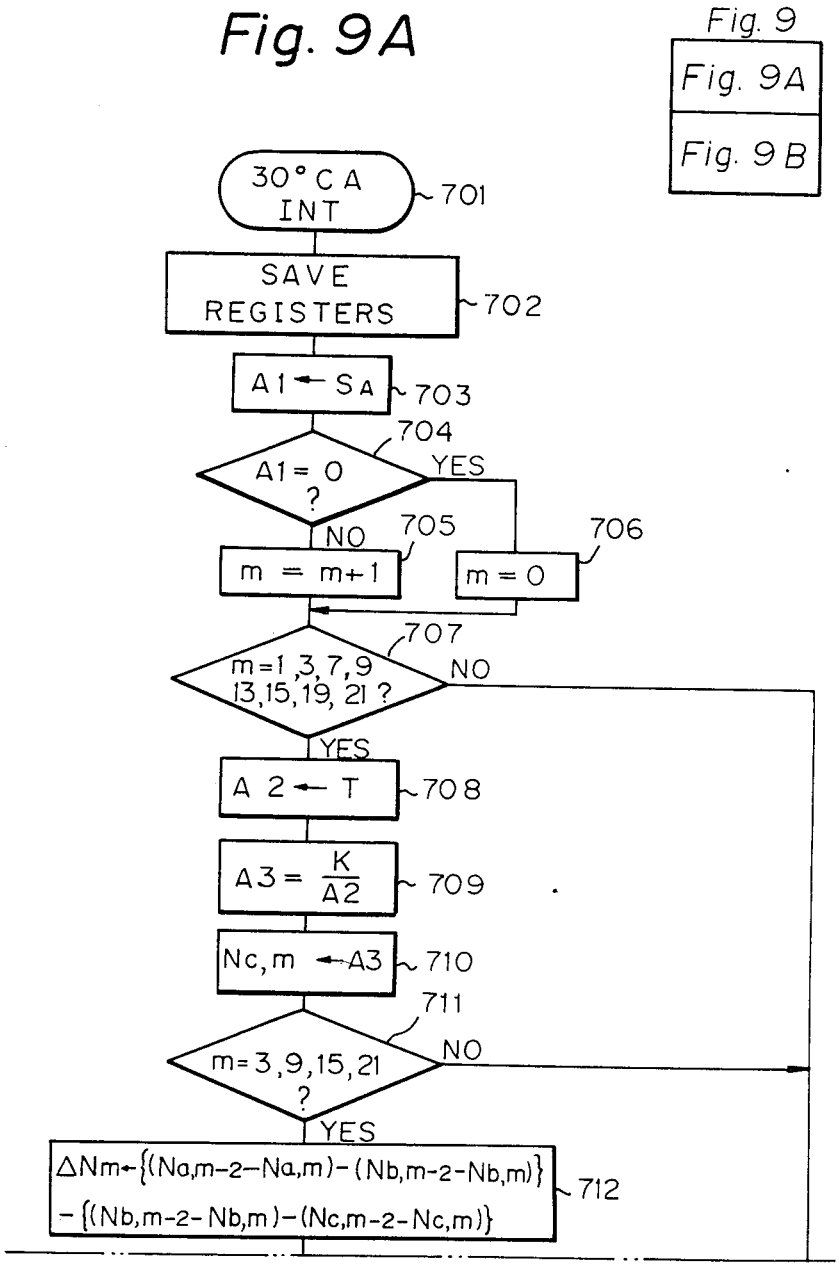
Figure 9B:
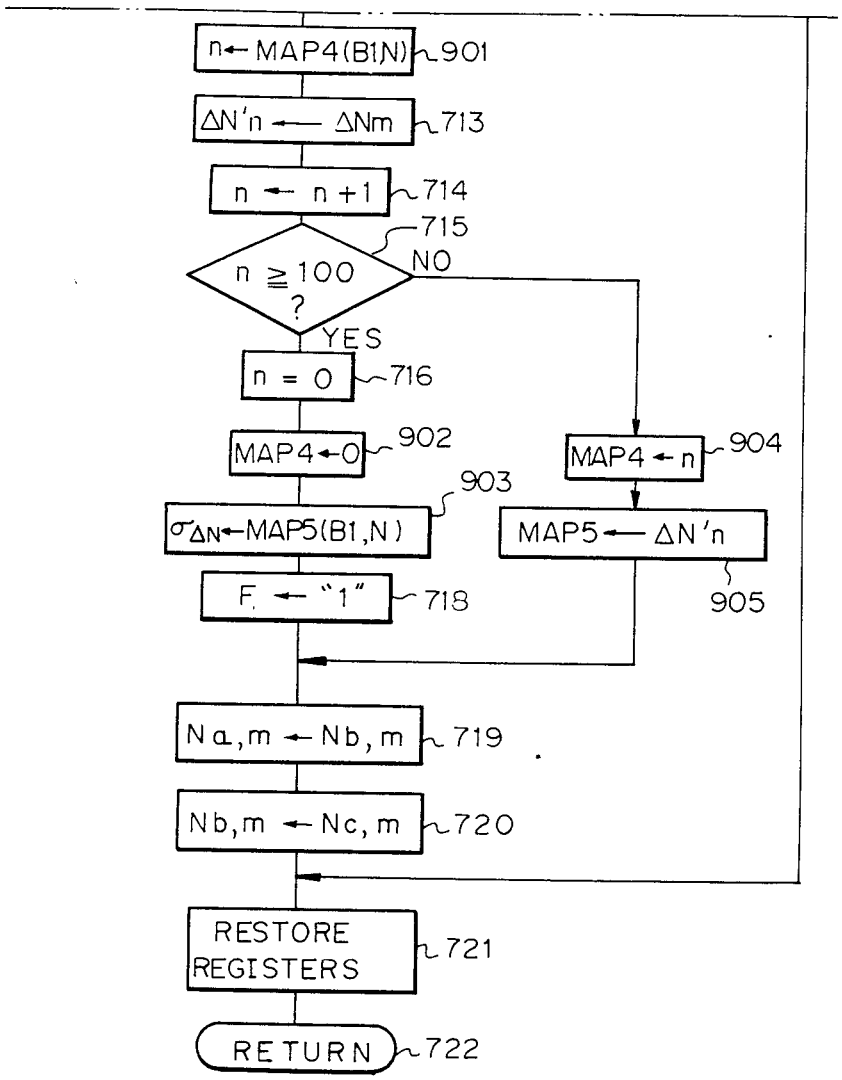

A read-only memory (ROM) 107 stores programs such as a main routine, an interrupt routine as illustrated in FIG. 5 or 8, an interrupt routine as illustrated in FIG. 7 or 9, and the like. A random-access memory (RAM) stores temporary data.

The operation of the control circuit 10 of FIG. 4 will be explained.

FIG. 5 is a flow chart of an interrupt routine carried out at every 720° CA. That is, an interrupt step 501 is started by every trailing edge of the TDC signal $S_A$ as illustrated in FIG. 6A.

At step 502, the CPU 106 saves the contents of the registers in the RAM 108. Then, at step 503, the CPU 106 fetches the intake air amount Q from the A/D converter 105, and at step 504, the CPU 106 reads the engine rotational speed N from the RAM 108, i.e., N←A3. Note that the engine rotational speed N is calculated as the value A3 in steps 708 and 709 of the routine of FIG. 7 and is stored in the RAM 108. Then, at step 505, the CPU 106 calculates the intake air amount per one revolution B1 by $$B1 \leftarrow K1 \cdot Q/N$$

where K1 is a constant. At step 506, the CPU 106 calculates a coefficient C1 of the base air-fuel ratio by using a two-dimensional map MAP1 in dependence upon the values B1 and N.

At step 507, the CPU 106 determines whether the flag F is "1" or "0", i.e., whether or not a standard deviation calculation as illustrated in FIG. 7 is completed. If the flag F is "1", the control flow advanced to step 508 which clears the flag F, and then advances to steps 509 through 512 which carry out a feedback operation of the air-fuel ratio. If the flag F is "0", the control flow jumps to step 713.

At step 509, in order to control the air-fuel ratio at a lean limit, the CPU 106 calculates a reference value C2 by using a two-dimensional map MAP2 in dependence upon the value B1 and N. At step 510, the CPU 106 compares the standard deviation $\sigma_{\Delta N}$ with the reference value C2. This standard deviation $\sigma_{\Delta N}$ is calculated in the routine as illustrated in FIG. 7. If $\sigma_{\Delta N} > C2$, this means that a combustion variation is generated. Therefore, at step 511, the air-fuel ratio compensation amount K2 is increased so as to enrich the air-fuel mixture. That is, $K2 \leftarrow K2 + \alpha$, where $\alpha$ is a constant. If $\sigma_{\Delta N} \leqq C2$, this means that no substantial combustion variation is generated. Therefore, at step 512, the air-fuel ratio compensation amount K2 is decreased so as to bring the air-fuel mixture to the lean side.

At step 513, the CPU 106 calculates an opening time period $\tau$ of the injectors 8 by $$\tau \leftarrow C1 \times K2 \times B1.$$

Thus, the feedback of the opening time period of the injectors 8 is controlled, so that the air-fuel ratio of the engine is controlled at a lean limit.

At step 514, the CPU 106 sets the opening time period $\tau$ calculated in step 513 in the comparator 109. Thus, the amount of fuel corresponding to the calculated opening time period is injected into the combustion chamber of each cylinder of the engine.

At step 515, the CPU 106 restores the registers to the state before the interruption routine was initiated. The routine of FIG. 5 is completed by return step 516.

The calculation of a standard deviation of engine rotational speed variations will be explained with reference to FIGS. 6A, 6B, 6C, and 7.

FIG. 6A is a waveform diagram of the TDC signal $S_A$. The signal $S_A$ is kept at "0" during an interval in which the crankshaft is rotated by 30° CA after the first cylinder reaches its top dead center.

FIG. 6B is a waveform diagram of the angle signal $S_B$. Each pulse number of the angle signal $S_B$ corresponds to a 30° CA rotation from the time at which the first cylinder reaches its top dead center. Thus, the first cylinder corresponds to pulse numbers 0 to 5, the third cylinder corresponds to pulse numbers 6 to 11, the fourth cylinder corresponds to pulse numbers 12 to 17, and the second cylinder corresponds to pulse numbers 18 to 23.

FIG. 6C is a waveform diagram of a mean engine rotational speed for each 30° CA period.

In FIG. 7, an interrupt step 701 is started by every trailing edge of the angle signal $S_B$. At step 702, the CPU 106 saves the contents of the registers into the RAM 108. Then, at step 703, the CPU 106 fetches the value of the TDC signal $S_A$ via the input/output interface 104 and stores it into a register A1. Note, A1 designates the value of the register A1 itself. At step 704, the CPU 106 determines whether or not A1 is "1". If A1="0", i.e., if the firing stroke for the first cylinder is initiated, a counter value m is cleared at step 706. If A1="1", the counter value m is counted up by +1. At step 707, the CPU 106 determines whether or not the content of the counter value m is any one of 1, 3, 7, 9, 13, 15, 19, and 21. If the content of the counter value m is 1, 3, 7, 9, 13, 15, 19, or 21, the control flow advances to step 712. If not, the control flow jumps to step 721.

At step 708, the CPU 106 fetches a rotation time period data T from the rotational speed counter circuit 103 via the input/output interface 104, and stores it in a register A2. Then, at step 709, the CPU 108 calculates the inverse number of the content of the register A2 and multiplies it by a suitable proportional coefficient K, thereby attaining an engine rotational speed N. The engine rotational speed N is stored in a register A3. At step 710, the content of the register A3 is stored in a memory $N_{c,m}$. In this case, eight memories $N_{c,m}$ (m=1, 3, 7, 9, 13, 15, 19, 21) are provided. For example, a mean engine rotational speed from 30° CA to 60° CA of the crankshaft for the firing stroke of the first cylinder is stored in the memory $N_{c,1}$, and a mean engine rotational speed from 90° CA to 120° CA of the crankshaft for the firing stroke of the third cylinder is stored in the memory $N_{c,3}$. Similarly, a mean engine rotational speed from 210° CA to 240° CA of the crankshaft for the firing stroke of the fourth cylinder is stored in the memory $N_{c,19}$, and a mean engine rotational speed from 270° CA to 300° CA of the crankshaft for the firing stroke of the second cylinder is stored in the memory $N_{c,21}$.

At step 711, the CPU 106 determines whether the counter value m equals 3, 9, 15, or 21. If m=3, 9, 15, or 21, the control flow advances to step 712. If not, the control flow jumps to step 721. At step 712, the CPU 106 calculates $$\Delta N_m \leftarrow \{(N_{a,m-2} - N_{a,m}) - (N_{b,m-2} - N_{b,m})\} - \{(N_{b,m-2} - N_{b,m}) - (N_{c,m-2} - N_{c,m})\}$$

where $N_{b,m-2}$ and $N_{b,m}$ are the values of $N_{c,m-2}$ and $N_{c,m}$, respectively, for the previous cycle, and $N_{a,m-2}$ and $N_{a,m}$ are the values of $N_{c,m-2}$ and $N_{c,m}$, respectively, for the further previous cycle. Note that, the above-mentioned calculation equation can be replaced by $$\Delta N_m \leftarrow N_{c,m-2} - N_{c,m}$$

or $$\Delta N_m \leftarrow \{(N_{b,m-2} - N_{b,m}) - (N_{c,m-2} - N_{c,m})\}.$$

Here, m is 3 for the first cylinder, 9 for the third cylinder, 15 for the fourth cylinder, and 21 for the second cylinder.

At step 713, the CPU 106 stores $\Delta N_m$ in a memory $\Delta N'_n$, i.e., $\Delta N'_n \leftarrow \Delta N_m$. Then, at step 714, a pointer value n is counted up by +1, and at step 715, the CPU 106 compares n with 100. If n>100, the control flow advances to step 715 in which the pointer value n is cleared. Then, at step 717, the CPU 106 calculates a standard deviation $\sigma_{\Delta N}$ of $\Delta N'_n$ by $$\Delta\sigma_N \leftarrow \sqrt{\frac{1}{100}\sum_{i=0}^{99}(\Delta N_i' - \overline{\Delta N})^2}$$

$$\text{where } \overline{\Delta N} = \frac{1}{100}\sum_{i=0}^{99}\Delta N_i'.$$

Thus, such a standard deviation is calculated for every 100 engine rotational speed variations. At step 718, the CPU 106 sets up the flag F which shows the completion of calculation of a standard deviation.

At step 719, the CPU 106 transmits the content of the memory $N_{b,m}$ to the memory $N_{a,m}$, and at step 720, the CPU 106 transmits the content of the memory $N_{c,m}$ to the memory $N_{b,m}$.

At step 721, the CPU 106 restores the registers to the state before the interruption routine was initiated. The routine of FIG. 7 is completed by return step 722.

In the routine as shown in FIG. 7, the standard deviation $\sigma_{\Delta N}$ calculated in step 717 relates to the cylinders in total. However, such a standard deviation can be obtained for each cylinder. In this case, at step 713, instead of $\Delta N'_n \leftarrow \Delta N_m$, $$\Delta N_{m,n} \leftarrow \Delta N_m$$

is prepared. In addition, at step 717, the CPU 106 calculates $$\sigma_{\Delta Nm} = \sqrt{\frac{1}{100}\sum_{i=0}^{99}(\Delta N_{m,i} - \overline{\Delta N_m})^2}$$

$$\text{where } \overline{\Delta N_m} = \frac{1}{100}\sum_{i=0}^{99}\Delta N_{m,i}$$

for m=3, 9, 15 and 21. Further, in this case, in the routine of FIG. 5, at step 509, four reference values C2(m=3), C2(m=9), C2(m=15), and C2(m=21) are calculated by respective two-dimensional maps, and at step 510, four comparisons are carried out. That is, $\sigma_{\Delta N,3} > C2(m=3)$ for the first cylinder;

$\sigma_{\Delta N,9} > C2(m=9)$ for the third cylinder;

$\sigma_{\Delta N,15} > C2(m=15)$ for the fourth cylinder; and $\sigma_{\Delta N,21} > C2(m=21)$ for the second cylinder.

If at least one of the four comparisons is satisfied, the control flow advances to step 511, while if none of the four comparisons are satisfied, the control flow advances to step 512.

FIG. 8 is a flowchart of the operation of the control circuit 10 of FIG. 3. In FIG. 8, steps 801 and 802 are added to the steps of the routine of FIG. 5. In the routine of FIG. 5, one air-fuel ratio compensation amount K2 is prepared regardless of the engine conditions, while in the routine of FIG. 8, an air-fuel ratio compensation amount K2 is prepared for each predetermined engine condition area defined by the driving operating parameters B1 and N. That is, in the routine of FIG. 8, a plurality of air-fuel ratio amounts are prepared.

The step 801, and its subsequent steps, of FIG. 8 will be explained. At step 801, the air-fuel compensation amount K2 is read out of a two-dimensional map MAP3 by using the parameters B1 and N as an address. Steps 509 and 512 are the same as those of FIG. 5. That is, the air-fuel ratio amount K2 is compensated by the feedback calculation routine defined by steps 509 to 512. At step 802, the compensated value K2 is again stored in the same address of the map MAP3 defined by B1 and N. Steps subsequent to step 802 are the same as those of FIG. 5.

FIG. 9 is an additional flowchart of the operation of the control circuit 10 of FIG. 3. In FIG. 9, steps 901 to 905 are provided instead of step 717 of FIG. 7. In the routine of FIG. 7, $\sigma_{\Delta N}$ is calculated in dependence upon a sequence of 100 pieces of data $\Delta N_m$, while in the routine of FIG. 9, $\sigma_{\Delta N}$ is calculated in dependence upon 100 pieces of data $\Delta N_m$ which belong to each engine condition area defined by the parameters B1 and N. That is, at step 901, the CPU 106 reads the counter value n from a two-dimensional map MAP4 by using the parameters B1 and N as an address. Then, at step 713, $\Delta N'_n \leftarrow \Delta N_m$, and at step 714, the counter value n is counted up by +1. If $n \geqq 100$ at step 715, then the control flow advances to step 716 in which the counter value is cleared. Also, at step 902, the content of the same address (B1, N) of the map MAP4 is cleared. In this state, a two-dimensional map MAP5 accumulates 100 pieces of data $\Delta N'_m$(n=0, 1, . . . , 99) in its address defined by B1 and N. Therefore, at step 718, the CPU 106 calculates a standard deviation $\sigma_{\Delta N}$ of $\Delta N'_n$ belonging to an area defined by B1 and N, that is, $$\Delta\sigma_N \leftarrow \sqrt{\frac{1}{100}\sum_{i=0}^{99}(\Delta N_i' - \overline{\Delta N})^2}$$

$$\text{where } \overline{\Delta N} = \frac{1}{100}\sum_{i=0}^{99}\Delta N_i'.$$

At step 718, the CPU 106 sets up the flag F.

If $n < 100$ at step 715, the control flow advances to step 903 in which the counter value n is rewritten into the same address of the map MAP4. At step 905, the calculated engine rotational speed variation $\Delta N'_n$ is accumulated in the area of the map MAP5 having the same address (B1, N).

Thus, in the routine of FIG. 9, $\Delta\sigma_N$ is calculated based upon engine speed variations belonging to the same engine condition, thereby obtaining an accurate value of $\Delta\sigma_N$.

In the routines as shown in FIGS. 8 and 9, a standard deviation can be also calculated for each cylinder, in the same way as in the routines as shown in FIGS. 5 and 7.

As explained above, any of the maps MAP1, MAP2, MAP3, MAP4, and MAP5 as used in the above-mentioned routine, are two-dimensional, depending upon the intake air amount B1 per one revolution of the engine and the engine rotational speed N. In this case, the maps MAP1 and MAP2 are provided in the ROM 107 since the contents of the maps MAP1 and MAP2 are fixed. Contrary to this, the maps MAP3, MAP4, and MAP5 are provided in the RAM 108, since the contents of these maps are renewed after each completion of execution of the routine.

For example, the map MAP1 is illustrated in FIG. 10. That is, the engine rotational speed N is divided into steps of 200 rpm, i.e., into N1, N2, . . . , and the intake air amount B1 per one revolution is divided into steps of 0.05 l/rev, i.e., into B1,1, B1,2, B1,3, . . . . Other maps comprise blocks divided in the same way as the map MAP1.

Obviously, such a standard deviation can be obtained by using either torque variations of the engine output or pressure variations within a cylinder of the engine.

Further, as stated above, a standard deviation is calculated by using 100 pieces of combustion variations, however, such a standard deviation can be calculated sufficiently by using more than 50 pieces of combustion variations.

We claim:

1. A method for controlling the air-fuel ratio in an internal combustion engine, comprising the steps of:

calculating a combustion variation by detecting a difference between values of an engine output parameter at two predetermined crank angle positions for every firing stroke of a predetermined cylinder of said engine;

calculating a first standard deviation of a plurality of said calculated combustion variations extending over one of a predetermined time period and a crank angle;

calculating a reference standard deviation of combustion variations in accordance with predetermined parameters of said engine; and controlling the air-fuel ratio of said engine so that said first calculated standard deviation approaches said calculated reference standard deviation.

2. A method as set for in claim 1, wherein said controlling step includes the steps of:

calculating an aimed air-fuel ratio of said engine in accordance with predetermined parameters of said engine;

determining whether said first calculated standard deviation is greater than said calculated reference standard deviation;

decreasing said aimed air-fuel ratio of said engine when said first calculated standard deviation is greater than said calculated reference standard deviation;

increasing said aimed air-fuel ratio of said engine when said first calculated standard deviation is not greater than said calculated reference standard deviation; and controlling the amount of fuel supplied to said engine so that the controlled air-fuel ratio of said engine approaches said aimed air-fuel ratio of said engine.

3. A method as set forth in claim 1, wherein said first standard deviation calculating step includes a step of calculating a standard deviation of said calculated combustion variations for each of regions of said predetermined parameter of said engine;

said reference standard deviation calculating step includes a step of calculating a reference standard deviation for each of said regions of said predetermined parameter of said engine; and said air-fuel ratio controlling step includes a step of controlling the air-fuel ratio of said engine so that said calculated standard deviation for one of said regions of said predetermined parameter of said engine approaches said reference standard deviation for the same region.

4. A method as set forth in claim 1, wherein said engine output parameter is the engine rotational speed of said engine.

5. A method as set forth in claim 1, wherein said engine output parameter is the engine torque of said engine.

6. A method as set forth in claim 1, wherein said engine output parameter is the pressure within said predetermined cylinder.

7. A method as set forth in claim 1, wherein said combustion variation calculating step includes a step of calculating a difference in said engine output parameter detected at said two predetermined crank angle positions for each firing stroke of said predetermined cylinder, said difference defining said combustion variation.

8. A method as set forth in claim 1, wherein said combustion variation calculating step includes the steps of:

calculating a first difference in said engine output parameter detected at said two predetermined crank angle positions for each firing stroke of said predetermined cylinder; and calculating a second difference in said first difference between two successive firing strokes of said predetermined cylinder, said second difference defining said combustion variation.

9. A method as set forth in claim 1, wherein said combustion variation calculating step includes the steps of:

calculating a first difference in said engine output parameter detected at said predetermined crank angle positions for each firing stroke of said predetermined cylinder;

calculating a second difference in said first difference between two successive firing strokes of said predetermined cylinder; and calculating a third difference between two successive second differences, said third difference defining said combustion variation.

10. A method as set forth in claim 1, wherein said first standard deviation calculating step includes a step of calculating said standard deviation in accordance with 50 calculated combustion variations.

11. A method as set forth in claim 3, wherein said regions of predetermined parameters of said engine are determined in accordance with the intake air amount per one revolution of said engine and the engine rotational speed.

12. An apparatus for controlling the air-fuel ratio in an internal combustion engine, comprising:

first means for calculating a combustion variation by detecting a difference between values of an engine output parameter at two predetermined crank angle positions for every firing stroke of a predetermined cylinder of said engine;

second means for calculating a first standard deviation of a plurality of said calculated combustion variations extending over one of a predetermined time period and a crank angle;

third means for calculating a reference standard deviation of combustion variations in accordance with predetermined parameters of said engine; and control means for controlling the air-fuel ratio of said engine so that said calculated standard deviation approaches said calculated reference standard deviation.

13. An apparatus as set forth in claim 12, wherein said control means comprises:

means for calculating an aimed air-fuel ratio of said engine in accordance with predetermined parameters of said engine;

means for determining whether said calculated first standard deviation is greater than said calculated reference standard deviation;

means for decreasing said aimed air-fuel ratio of said engine when said calculated first standard deviation is greater than said calculated reference standard deviation;

means for increasing said aimed air-fuel ratio of said engine when said calculated first standard deviation is not greater than said calculated reference standard deviation; and means for controlling the amount of fuel supplied to said engine so that the controlled air-fuel ratio of said engine approaches said aimed air-fuel ratio of said engine.

14. An apparatus as set forth in claim 12, wherein said second calculating means includes means for calculating a standard deviation of said calculated combustion variations for each of regions of said predetermined parameter of said engine;

said third calculating means includes means for calculating a reference standard deviation for each of said regions of said predetermined parameter of said engine; and said control means includes means for controlling the air-fuel ratio of said engine so that said calculated standard deviation for one of said regions of said predetermined parameter of said engine approaches said reference standard deviation for the same region.

15. An apparatus as set forth in claim 12, wherein said engine output parameter is the engine rotational speed of said engine.

16. An apparatus as set forth in claim 12, wherein said engine output parameter is the engine torque of said engine.

17. An apparatus as set forth in claim 12, wherein said engine output parameter is the pressure within said predetermined cylinder.

18. An apparatus as set forth in claim 12, wherein said first means includes a means for calculating a difference in said engine output parameter detected at said two predetermined crank angle positions for each firing stroke of said predetermined cylinder, said difference defining said combustion variation.

19. An apparatus as set forth in claim 12, wherein said first calculating means comprises:

means for calculating a first difference in said engine output parameter detected at said two predetermined crank angle positions for each firing stroke of said predetermined cylinder; and means for calculating a second difference in said first difference between two successive firing strokes of said predetermined cylinder, said second difference defining said combustion variation.

20. An apparatus as set forth in claim 12, wherein said first calculating means comprises:

means for calculating a first difference in said engine output parameter detected at said predetermined crank angle for each firing stroke of said predetermined cylinder;

means for calculating a second difference in said first difference between two successive firing strokes of said predetermined cylinder; and means for calculating a third difference between two successive second differences, said third difference defining said combustion variation.

21. An apparatus as set forth in claim 12, wherein said second calculating means comprises means for calculating said standard deviation in accordance with 50 calculated combustion variations.

22. An apparatus as set forth in claim 14, wherein said regions of predetermined parameters of said engine are determined in accordance with the intake air amount per one revolution of said engine and the engine rotational speed.

* * * * *